US005465959A

United States Patent [19]

Cheng

[11] Patent Number: 5,465,959

[45] Date of Patent: Nov. 14, 1995

[54] GOLF CLUB BODY MADE OF COMPOSITE MATERIAL AND HAVING A BENT FRONT SECTION

[75] Inventor: Cheng-Hsien Cheng, Kaohsiung, Taiwan

[73] Assignee: Advanced Composite Designs Co., Ltd., Kaohsiung, Taiwan

[21] Appl. No.: 357,311

[22] Filed: Dec. 16, 1994

[51] Int. Cl.[6] ..... A63B 53/02

[52] U.S. Cl. ..... 273/80 B; 273/80.2; 273/DIG. 8

[58] Field of Search ..... 273/80 R, 80 B, 273/80.1, 80.2, 80.3, 80.4, 80.5, 80.6, 80.7, 80.8, 80.9, DIG. 8, 73 G, 80 C, 167 G

[56] References Cited

U.S. PATENT DOCUMENTS

| | | | |
|---|---|---|---|
| 695,579 | 3/1902 | Parmele | 273/80.2 |
| 1,680,447 | 8/1928 | Bryant | 273/80 R |
| 1,715,586 | 6/1929 | Barkley | 273/80 R |
| 1,792,034 | 2/1931 | Reach | 273/80 R |
| 1,958,032 | 5/1934 | Cocke | 273/80.2 |
| 1,983,069 | 12/1934 | Cowdery | 273/80.3 |
| 2,146,048 | 2/1939 | Barnhart | 273/80 C |
| 2,463,053 | 3/1949 | Pritchard | 273/80.1 |
| 3,081,087 | 3/1963 | Redd | 273/80.2 |
| 3,825,991 | 7/1974 | Cornell | 273/80.2 |
| 4,470,600 | 9/1984 | Parente | 273/80.8 |
| 5,184,819 | 2/1993 | Besbiolles | 273/80.2 |
| 5,205,552 | 4/1993 | Green | 273/80.2 |
| 5,253,867 | 10/1993 | Gafner | 273/80 R |
| 5,333,862 | 8/1994 | Teramoto | 273/80 C |

FOREIGN PATENT DOCUMENTS

| | | | |
|---|---|---|---|
| 434533 | 9/1935 | United Kingdom | 273/80 B |
| 01391768 | 4/1975 | United Kingdom | 273/80 B |

*Primary Examiner*—Sebastiano Passaniti

*Attorney, Agent, or Firm*—Morton J. Rosenberg; David I. Klein

[57] ABSTRACT

Disclosed is a golf club body made of composite material and having a bent front section, consisting generally of a straight, tapered hollow body made of carbon fiber, a bent section connected to a tapered front end of the straight body and being formed of a carbon fiber outer wall and core retained therewithin, and a link connecting the body and bent sections. The bent section has a recess of sufficient depth circumferentially formed in an inner wall of one end having substantially the same diameter as that of the tapered end of the straight body section, such that the link is permitted to be fixedly engaged within the bent section recess at one end and within the tapered end of the body at the other end, to thereby firmly connect the bent section to the straight hollow body section.

5 Claims, 2 Drawing Sheets

GOLF CLUB BODY MADE OF COMPOSITE MATERIAL AND HAVING A BENT FRONT SECTION

BACKGROUND OF THE INVENTION

The present invention relates to a golf club body made of composite material and having an offset front section, and more particularly to a simple but useful improvement in the assembly of golf club parts for producing a golf club made of composite material having a bent front section to provide golfers with one or more alternative of differently constructed golf clubs.

With the popularity of golf, to own a complete set of structurally superior, qualified, and handy golf clubs has become an expectancy of most golfers. A golf club mainly consists of a body, a head connected to a front end of the body for striking a ball, and a handle connected to a rear end of the body for gripping by a user. Although the golf club substantially consists of only three simple parts, the structural arrangement of those three parts has significant effects on the orientation, accuracy, stability, and feel of striking impact when the golf club is used to strike a ball. Furthermore, in consideration of the weight, flexibility, shock-absorbing ability, torque resistance, etc. of the golf club, different materials, such as composite material (usually carbon fiber), aluminum tube, and wood are used to produce golf clubs.

A common and conventional golf club generally has a body in the form of a straight and tapered hollow stem of sufficient length. However, since all golfers do not share the same preference as to the manner by which to hold the club and strike the ball, it is desirable to provide golfers with other alternatives of differently designed golf club bodies, one example of which is illustrated in FIG. 1, in which the golf club has a non-straight hollow body, and in particular, has a slightly bent front part for connection of a head thereto. When a golf club with this bent configuration is used to strike a ball, a different feeling upon striking impact is sensed by the user. Such a golf club can be suitably and timely used to strike the ball with varying degrees of impact conditions. For these reasons, such a golf club with a bent front section has become more and more popular.

The golf club as shown in FIG. 1 is, however, not easily integrally molded from the composite material commonly used to produce a golf club with a straight body. That is, in the event the bent body of a golf club is produced using a conventional method of integral molding, there is no way to pull off the core from the mold. As a result, a bent golf club body, at the present time, can in practice only be formed from a metal pipe. That is, most of the existing golf clubs having a bent front section are made of metal. Moreover, even if such a bent metal golf club is somewhat more effective in striking the balls, it is not completely suitable for every user because each golfer has a different preference as to the material from which the golf club is produced. The metal golf club as shown in FIG. 1 is incapable of providing for a user who prefers golf clubs made of composite material a feel consistent with that offered by the other clubs he or she is using. It is, therefore, desirable to develop a golf club made of composite material and having a bent front section to provide another alternative for the golfer who prefers golf clubs having a body made of composite material.

SUMMARY OF THE INVENTION

A primary object of the present invention is to provide a golf club made of composite material and having a non-straight/bent front section, mainly consisting of a straight and tapered hollow body made of carbon fiber, a bent section having an outer wall made of carbon fiber and an inner core enclosed by the other wall, and a link. A recess is circumferentially formed on an inner wall of the bent section at one end thereof to axially extend toward an inner part thereof a predetermined extent. The link may be suitably and firmly inserted into and thereby engaged with the straight and tapered body at one end and the circumferential recess of the bent section at the other end to thereby complete a golf club made of carbon fiber and having a bent front section.

DETAILED DESCRIPTION OF THE PREFERRED EMBODIMENT

Figure 2:
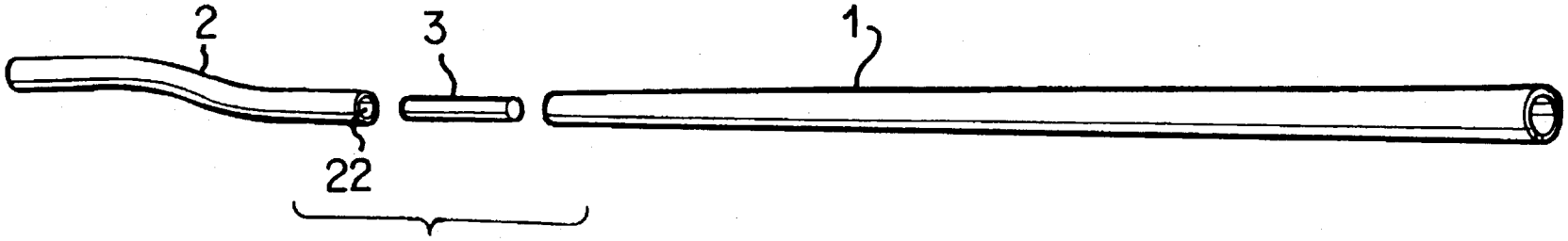
FIG. 2 is a disassembled perspective view of a golf club body according to the present invention.
Figure 3:
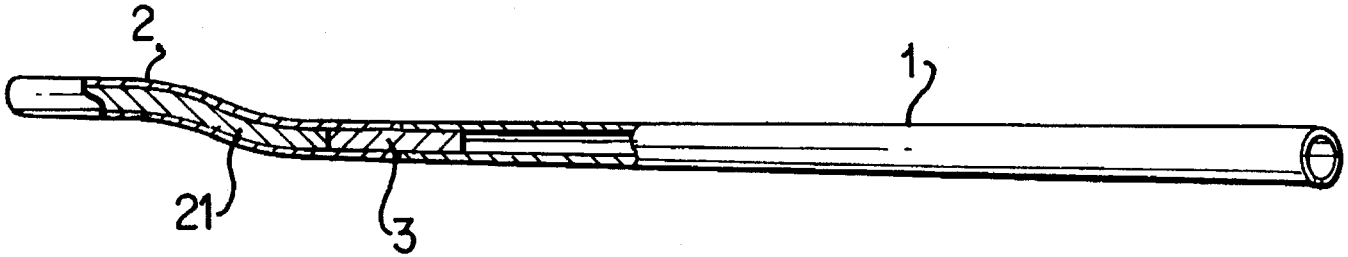
FIG. 3 is a perspective view of an assembled golf club body formed by assembling the parts shown in FIG. 2; and, FIG. 4 is a perspective view of an embodiment of the golf club incorporating a golf club body formed according to the present invention.

Referring to FIGS. 2 and 3, the present invention relates to a golf club body which mainly consists of a straight and tapered hollow body 1 made of composite material, a bent section 2 made of carbon fiber with a core 21 wrapped therewithin, and a link 3 for coupling the body 1 with the bent section 2. The straight body 1 is similar to a conventional golf club body but made of carbon fiber, of which the inner wall at the tapered end may be coarsened. The bent section 2 is formed by wrapping the core 21 with carbon fiber fabric and then thermally pressing the latter to form a desired shape. The bent section 2 has a uniform outer diameter which is generally the same as that of the tapered end of the straight body 1. A recess 22 is circumferentially formed on an inner wall of the bent section 2 at one end thereof (opposite the other end to which a head for striking balls is connected) to axially extend toward an inner part thereof a predetermined extent. The recess 22 has an inner diameter substantially the same as that of the tapered end of the straight body 1. The link 3 is made of steel and has a diameter which is adapted for fittingly engaging the recess 22 of the bent section 2 at one end and the tapered end of the straight body 1 at another end to firmly join the body 1 and the bent section 2.

For the link 3 to be firmly engaged into the carbon fiber straight body 1 and the bent section 2 one approach is to coarsen the inner wall of the tapered end of the straight body 1 and an outer wall of the link 3 before any suitable adhesive is spread over the link 3, the inner wall of the tapered end of the straight body 1, and an inner wall of the recess 22 of the bent section 22. Then, a jig is used to tightly clamp the joint between the connected straight body 1 and the bent section 2 before the two connected pieces 1, 2 of the club are placed into an oven for hardening. When the joint connected by the link 3 is examined and found to be free of any risk of coming loose, a suitable filler is used to smooth the joint before the joined club body is placed again into the oven for further hardening. Finally, the club body is further smoothed and finished by rough polish and fine polish, and paint coating.

Figure 1:
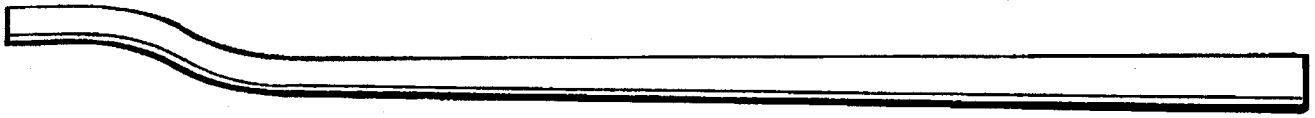
FIG. 1 generally illustrates a conventional golf club made of metal.
Figure 4:
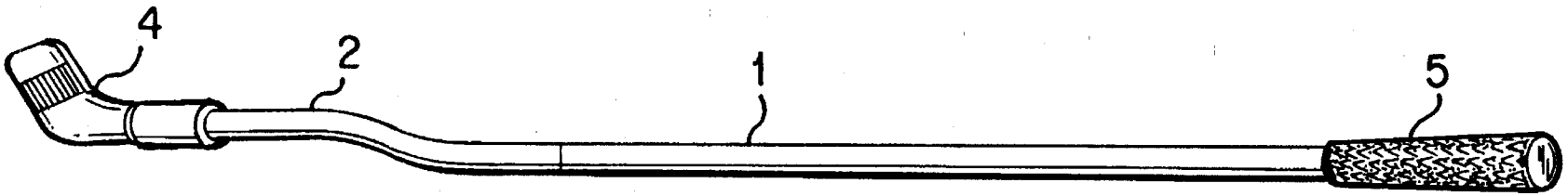

Referring now to FIG. 4 in which an embodiment of the golf club incorporating a golf club body formed according to the present invention is shown, the formed golf club is made of carbon fiber and consists of a straight body 1 having a bent front section 2, a head 4 attached to a front end of the bent section 2, and a handle 5 attached to the rear end of the straight body 1. Such a golf club is tested and proven to be a fully qualified club. In particular, its carbon-fiber body 1 with a bent front section 2 (the bending angle thereof is shown in the Figure and is substantially the same as that of conventional golf clubs) may practically satisfy golfers who prefer golf clubs made of composite material but who, heretofore, did not have available to them a golf club providing the benefits of a bent golf club body but made of composite material.

The wrapped core 21 of the bent section 2 according to the present invention may be any suitable type of foaming resin or air sac. The disposition of foaming resin core or air sac inside the carbon fiber fabric and the thermal press molding of the club in a mold shall both facilitate the production of a bent section 2 connected to the body 1. In this form, the core 21 does not unduly affect the weight standard of the overall golf club, nor does it reduce any of the toughness thereof.

Although this invention has been described in connection with specific forms and embodiments thereof, it will be appreciated that various modifications other than those discussed above may be resorted to without departing from the spirit or scope of the invention as defined in the appended claims.

What is claimed is:

1. A golf club body for coupling a handle to a striking head of a golf club and formed of composite material and having a bent front section comprising:

(a) a longitudinally-extending, straight, tapered hollow body section formed of said composite material;

(b) a bent section formed of said composite material and having a first end for connecting said striking head thereto and an opposing second end, said second end being laterally offset from said first end and being coupled to a tapered end of said hollow body section, said bent section further having a recess circumferentially formed within an inner wall of said second end thereof and axially extending toward said first end; and, (c) a substantially uniform diameter link for fixedly coupling said hollow body section to said bent section, said link diameter being substantially equal to an inner diameter of said tapered end of said hollow body section and to an inner diameter of said recess of said bent section, one end of said link being engaged within said recess formed at said second end of said bent section and an opposing end of said link fixedly engaged within said tapered end of said hollow body section.

2. The golf club body as recited in claim 1, wherein said composite material is carbon fiber.

3. The golf club body as recited in claim 1, wherein said link is formed of steel.

4. The golf club body as recited in claim 1, wherein said bent section includes a foaming resin core.

5. The golf club body as recited in claim 1, wherein said bent section includes an internal chamber forming an air sac.

* * * * *